US006651458B1

(12) United States Patent
Ebara et al.

(10) Patent No.: US 6,651,458 B1
(45) Date of Patent: Nov. 25, 2003

(54) INTERNAL INTERMEDIATE PRESSURE 2-STAGE COMPRESSION TYPE ROTARY COMPRESSOR

(75) Inventors: Toshiyuki Ebara, Osaka (JP); Masaya Tadano, Osaka (JP); Takashi Yamakawa, Osaka (JP); Atsushi Oda, Osaka (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/048,975

(22) PCT Filed: Aug. 30, 2000

(86) PCT No.: PCT/JP00/05856

§ 371 (c)(1),
(2), (4) Date: Jun. 14, 2002

(87) PCT Pub. No.: WO01/16490

PCT Pub. Date: Mar. 8, 2001

(30) Foreign Application Priority Data

Aug. 31, 1999 (JP) ..... 11-245005

(51) Int. Cl.[7] ..... F25B 43/02; F25B 1/10
(52) U.S. Cl. ..... 62/510; 62/84
(58) Field of Search ..... 62/508, 510, 490, 62/84; 418/11, 60

(56) References Cited

U.S. PATENT DOCUMENTS 5,071,328 A * 12/1991 Schlictig ..... 418/15
5,322,424 A 6/1994 Fujio
6,318,981 B1 * 11/2001 Ebara et al. ..... 418/11
6,568,198 B1 * 5/2003 Tadano et al. ..... 62/217

FOREIGN PATENT DOCUMENTS

EP 0 679 809 A2 11/1995
EP 0 935 106 A2 8/1999
JP 60-128990 7/1985

(List continued on next page.)

OTHER PUBLICATIONS

Patent Abstracts of Japan, vol. 018, No. 016, Jan. 12, 1994 (corresponds to JP 05–256285).
Patent Abstracts of Japan, vol. 1999, No. 08, Jun. 30, 1999 (corresponds to JP 11–062863).

(List continued on next page.)

*Primary Examiner*—Melvin Jones
(74) *Attorney, Agent, or Firm*—Armstrong, Westerman & Hattori, LLP

(57) ABSTRACT

An internal intermediate pressure type two-stage compression rotary compressor (10) is provided with an electrically driven element (14) disposed within a sealed vessel (12), and first and second rotary compression elements (32, 34) driven by the electrically driven element (14), and is structured such as to discharge $CO_2$ refrigerant gas compressed at a first stage by the first rotary compression element (32) within the sealed vessel (12) and compress the discharged refrigerant gas having an intermediate pressure at a second stage by the second rotary compression element (34) via an accumulator (106). The rotary compression elements (32, 34) include upper and lower cylinders (38, 40), upper and lower rollers (46, 48) eccentrically rotating within the cylinder and upper and lower vanes (50, 52) brought into contact with the rollers so as to section the inner portions of the upper and lower cylinders into high pressure chambers and low pressure chambers. A ratio of volume between the upper and lower cylinders (38, 40) executing the compression operation at the first stage and the second stage is set to 1:0.65 so that an equilibrium pressure becomes equal to an intermediate pressure.

Since a pressure change at a time of starting is reduced, an oil foaming is restricted and it, is possible to easily employ a withstand pressure design of a sealed vessel, it is possible to easily design a withstand pressure vessel and it is possible to reduce a weight of the pressure vessel.

7 Claims, 2 Drawing Sheets

FOREIGN PATENT DOCUMENTS

| | | | |
|---|---|---|---|
| JP | 3-179191 | | 8/1991 |
| JP | 2812022 | B2 | 5/1993 |
| JP | 5-231365 | | 9/1993 |
| JP | 5-256285 | | 10/1993 |
| JP | 9-151847 | | 6/1997 |
| JP | 10-141270 | | 5/1998 |
| JP | 020011263281 | * | 9/2001 |
| WO | WO 90/07683 | | 7/1990 |

OTHER PUBLICATIONS

Patent Abstracts of Japan, vol. 1999, No. 13, Nov. 30, 1999 (corresponds to JP 11–230072 ).

Microfilm of the Specification and Drawings Annexed to the Request of Japanese Utility Model Application No. 142408/1981)(Laid–Open No. 46886/1983) (Tokyo Shibaura Denki K.K.), Mar. 29, 1983, p. 9, lines 7 to 12; Fig. 5. (Translation attached).

Sanyou Denki, $CO_2$ Reibaiyou no Mippeigata Compressor WO Kaihatsu, Nikkei Mechanical (Japan) Nikkei BP K.K.. Jan. 11, 1999, p. 60, p. 61. (Translation attached).

* cited by examiner

INTERNAL INTERMEDIATE PRESSURE 2-STAGE COMPRESSION TYPE ROTARY COMPRESSOR

TECHNICAL FIELD

The present invention relates to an internal intermediate pressure type two-stage compression rotary compressor, and more particularly to an internal intermediate pressure type two-stage rotary compressor, for example, which can reduce a pressure change at a time of starting and can reduce a weight of a pressure vessel.

BACKGROUND ART

In conventional, in a two-cylinder type two-state compression rotary compressor in which an electrically driven element and two rotary compression elements are arranged and received within a sealed vessel, the sealed vessel is used as an internal low pressure type of an internal, intermediate pressure type.

In the case of the internal low pressure type, a refrigerant gas having a low temperature and a low pressure and returning to an inner portion of the sealed vessel from an external refrigerant circuit constituting a refrigerant cycle via an accumulator is sucked from a suction passage so as to be compressed at a first stage by a first rotary compression element, and is thereafter fed out to an intermediate cooling device positioned at an external portion, thereafter the refrigerant gas having an intermediate pressure is directly sucked to a second rotary compression element by a refrigerant pipe and is further compressed at a second stage, and the refrigerant gas having a high temperature and a high pressure is fed out to the external refrigerant circuit mentioned above by the refrigerant pipe.

On the contrary, in the case of the internal intermediate pressure type, the refrigerant gas having the low temperature and the low pressure and returning from the external refrigerant circuit constituting the refrigerant cycle via the accumulator is directly sucked to the first rotary compression element by the refrigerant pipe, and is compressed here so as to be discharged within the sealed vessel. Next, the discharged refrigerant gas having the intermediate pressure is compressed by the second rotary compression element so as to be fed out as the refrigerant gas having the high temperature and the high pressure to the external refrigerant circuit. That is, the pressure of the refrigerant gas discharged within the sealed vessel becomes the intermediate pressure between the first stage suction pressure and the second stage discharge pressure. Then, the intermediate pressure is determined on the basis of a bearing load, work loads in the respective stages, and the like.

However, in the case that the intermediate pressure is lower than a pressure (an equilibrium pressure) at a time when the compressor stops, a difference between the high pressure and the low pressure is lost and the, pressure within the compressor becomes an equilibrium state, the pressure within the sealed vessel is rapidly reduced at a time of starting the compressor, the refrigerant lying up in the oil together therewith becomes bubbles and an oil foaming is generated. Further, in the case that the intermediate pressure is higher than the equilibrium pressure, at a time when the compressor stops, the refrigerant gas running into the oil after starting becomes bubbles due to an increase of temperature of the sealed vessel, whereby the oil foaming is generated. Further, in the case of using a $CO_2$ refrigerant, the refrigerant pressure reaches 100 kg/cm$^2$G in a high pressure side, and 30kg/cm$^2$G in a low pressure side, and an amount of oil flowing out to the low pressure side due to the pressure difference is increased. Further, it is necessary to apply any higher withstand pressure design among that against the intermediate pressure and that against the equilibrium pressure to the sealed vessel.

Accordingly, a main object of the present invention is to provide an internal intermediate pressure type two-stage compression rotary compressor which can reduce a pressure change at a time of starting or the like, can easily employ a withstand pressure design of a sealed vessel and can reduce a weight of the pressure vessel.

DISCLOSURE OF THE INVENTION

In accordance with the present invention, there is provided an internal intermediate pressure type two-stage compression rotary compressor comprising, an electrically driven element provided within a sealed vessel, first and second rotary compression elements driven by the electrically driven element, $CO_2$ refrigerant gas compressed at a first stage by the first rotary compression element, being discharged within the sealed vessel and the discharged refrigerant gas having an intermediate pressure, being compressed at a second stage by the second rotary compression element, wherein a ratio of volume between the rotary compression element at the first stage and the rotary compression element at the second stage is set so that the equilibrium pressure becomes equal to the intermediate pressure.

The pressure change at a time of starting becomes small by setting the ratio of volume of the rotary compression elements executing the first and second stages of compression to a range between 1:0.5 and 1:0.8, whereby it is possible to restrict the oil foaming from being generated. Further, the withstand pressure design standard becomes 7000 kPa which is substantially equal to the equilibrium pressure, and becomes a value equal to that of the internal low pressure type.

The object mentioned above, the other objects, features and advantages of the present invention will be further apparent on the basis of the following detailed description of an embodiment given with reference to the accompanying drawings.

BEST MODE FOR CARRYING OUT THE INVENTION

Figure 1:
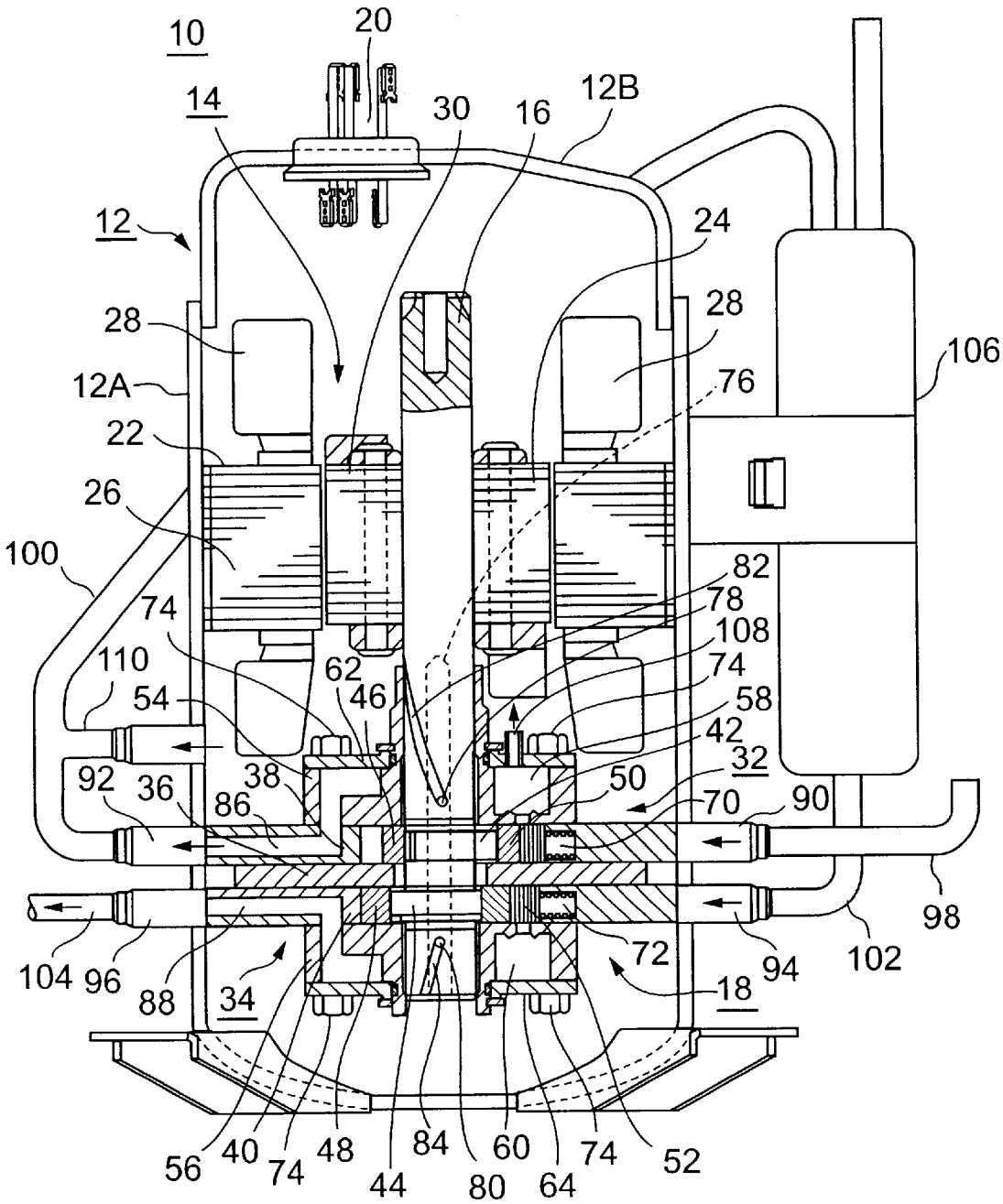
FIG. 1 is a vertical cross sectional view of a main portion of an internal intermediate pressure type two-stage compression rotary compressor corresponding to an embodiment in accordance with the present invention.

An internal intermediate pressure type two-stage compression rotary compressor 10 corresponding to an embodiment in accordance with the present invention shown in FIG. 1 includes a cylindrical sealed vessel 12 made of a steel plate, an electrically driven element 14 arranged in an upper space within the sealed vessel 12, and a rotary compression mechanism 18 positioned in a lower portion of the electrically driven element and driven by a prank shaft 16 connected to the electrically driven element 14.

Figure 2:
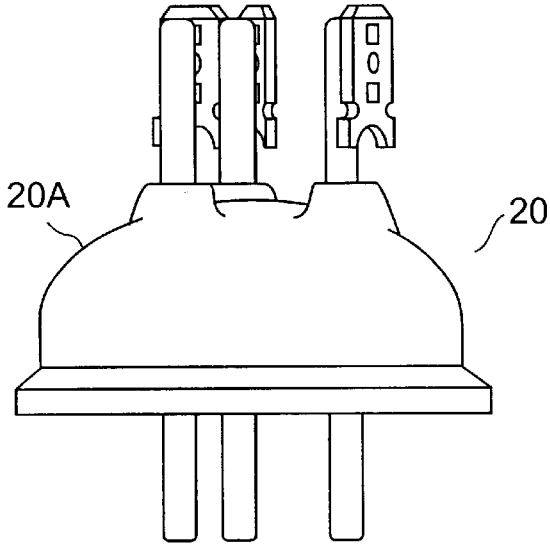
FIG. 2 is a schematic view showing another embodiment of a terminal post portion in FIG. 1.

Further, the sealed vessel 12 has an oil storage for a lubricating oil formed in a bottom portion, and is constituted by two members comprising a vessel main body 12A receiving the electrically driven element 14 and the rotary compression mechanism 18 and a lid body 12B closing an upper opening of the vessel main body 12A. A terminal post 20 (a wire is omitted) for supplying an external electric power to the electrically driven element 14 is mounted to the lid body 12B. In this case, the terminal post 20 is structured such that a main body portion 20A is formed in a flat surface shape as illustrated, however, in the case that the sealed vessel 12 is of an internal intermediate pressure or an internal high pressure, a deformation of the main body portion 20A is hard to be generated by protruding a shape of the main body portion 20A upward so as to form a curved surface shape as shown in FIG. 2, whereby a strength of the terminal post 20 is improved.

The electrically driven element 14 is constituted by a stator 22 annularly mounted along an upper inner peripheral surface of the sealed vessel 12, and a rotor 24 arranged in an inner side of the stator 22 with a slight gap. A crank shaft 16 extending in a vertical direction passing through a center of the rotor 24 is fixed to the rotor 24. The stator 22 has a layered body 26 obtained by laminating ring-like electromagnetic steel plates, and a plurality of coils 28 wound around the layered body 26. Further, the rotor 24 is also an alternating current motor constituted by an electromagnetic steel plate layered body 30 as in the same manner as that of the stator 22. Further, it is possible to form as a DC motor in which a permanent magnet is inserted.

The rotary compression mechanism 18 includes a first rotary compression element 32 executing a compression at a first stage (in a low stage side) and a second rotary compression element 34 executing a compression at a second stage (in a high stage side). That is, it is constituted by an intermediate partition plate 36, upper and lower cylinders 38 and 40 respectively arranged in an upper side and a lower side of the intermediate partition plate 36, upper and lower rollers 46 and 48 connected to upper and lower eccentric portions 42 and 44 of the crank shaft 16 and rotating within the upper and lower cylinders 38 and 40, upper and lower vanes 50 and 52 brought into contact with the upper and lower rollers 46 and 48 so as to respectively section inner portions of the upper and lower cylinders 38 and 40 into low pressure chambers 38*a* and 40*a* and high pressure chambers 38*b* and 40*b*, and an upper supporting member 54 and a lower supporting member 56 closing upper and lower openings of the upper and lower cylinders 38 and 40 and commonly serving as a bearing of the crank shaft 16 (refer to FIG. 3).

Discharge sound absorbing chambers 58 and 60 suitably communicating with the respective high pressure chambers of the upper and lower cylinders 38 and 40 are formed in the upper supporting member 54 and the lower supporting member 56, and opening surfaces of the respective sound absorbing chambers are closed by an upper plate 62 and a lower plate 64.

Figure 3:
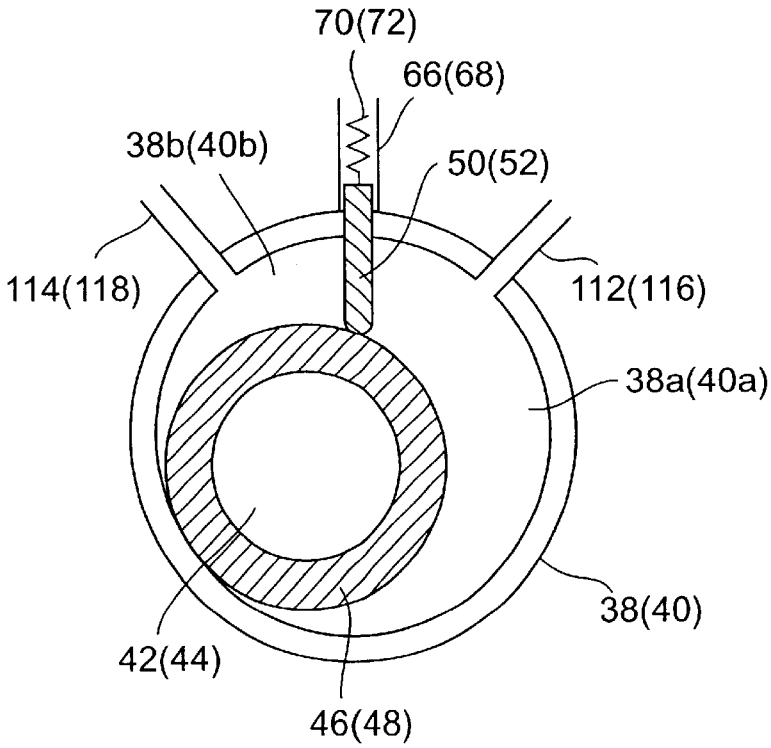
FIG. 3 is a schematic cross sectional view of a main portion in respective compression portions in FIG. 1.

Further, as shown in FIG. 3, the upper and lower vanes 50 and 52 are arranged in radially disposed guide grooves 66 and 68 formed in cylinder walls of the upper and lower cylinders 38 and 40 so as to freely oscillate and slide, and are urged by springs 70 and 72 so as to be always brought into contact with the upper and lower rollers 46 and 48. Further, in the upper cylinder 38, a compression operation at the first stage is executed, and in the lower cylinder 40, the compression operation at the second stage is executed by sucking the refrigerant gas compressed by the upper cylinder 38.

In this case, in order to keep the inner portion of the sealed vessel 12 under an equilibrium pressure, that is, the intermediate pressure equal to the pressure at a time when the compressor stops, a difference between the high and low pressures is lost and the pressure within the compressor becomes an equilibrium pressure, a ratio of volume between the rotary compression element 32 at the first stage and the rotary compression element 34 at the second stage is set to a range between 1:0.56 and 1:0.8. In this embodiment, the ratio of volume is set to 1:0.65.

For example, in the case that inner diameters of the upper and lower cylinders 38 and 40 are equal to each other, it is possible to correspond by changing a height (a thickness) thereof. That is, a height of the roller 48 in the lower cylinder at the second stage is made smaller than that of the roller 46 in the upper cylinder 38 at the first stage. Otherwise, in the case that the heights of the upper and lower cylinders 38 and 40 are equal to each other, an outer diameter of the lower roller 48 is made larger than an outer diameter of the upper roller 46 by changing the outer diameters of the upper and lower rollers 46 and 48. In a particular method, it is possible to easily correspond by changing the outer diameter of the roller and an amount of eccentricity in the eccentric portion.

In this case, a description will be given of a value of the ratio of volume. As a result of experimenting under a condition of the ratio of volume 1:0.55, the intermediate pressure becomes 80 kgf/cm$^2$, the equilibrium pressure becomes 60 kgf/cm$^2$ and the intermediate pressure > the equilibrium pressure is established. Accordingly, if the ratio of volume at the second stage is increased, it is assumed that the intermediate pressure is reduced, so that the value 0.8 corresponds to an upper limit value for functioning as the two-stage compressor.

Further, a material of the upper roller 46 and the upper vane 50 constituting the rotary compression element 32 at the first stage is made different from a material of the lower roller 48 and the lower vane 52 constituting the rotary compression element 34 at the second stage. That is, a roller (a monicro: a Ni, Cr and Mo alloy additive wear resisting cast iron) and a vane (SKH: a high speed tool steel) made of a soft and inexpensive material are used in the upper cylinder 38 at the first stage having a small compression load, and a roller (an alloy tarkalloy: a Ni, Cr, Mo and Bo alloy additive wear resisting cast iron) and a vane (PVD treatment: vacuum depositing a chrome nitride CrN on a surface of an SHK base material) made of an expensive and hard material are used in the lower cylinder 40 at the second stage having a large compression load, whereby it is possible to achieve a high durability and a cost reduction. Examples of the combination mentioned above will be shown below.

| | ROLLER MATERIAL | VANE MATERIAL |
|---|---|---|
| FIRST STAGE | MONICRO | SHK |
| SECOND STAGE | TARKALLOY | PVD TREATMENT |

Then, the upper supporting member 54, the upper cylinder 38, the intermediate partition plate 36, the lower cylinder 40 and the lower supporting member 56 which constitute the rotary compression mechanism 18 mentioned above are arranged in this order, and are connected and fixed together with the upper plate 62 and the lower plate 64 by using a plurality of mounting bolts 74.

In a lower portion of the crank shaft 16, a straight oil hole 76 is formed in an axial center, and spiral oil supplying grooves 82 and 84 connected to the oil hole 76 via oil supplying holes 78 and 80 in a lateral direction are formed on an outer peripheral surface, whereby the structure is made such as to supply the oil to the bearing in the upper supporting member 54 and the lower supporting member 56 and the respective sliding portions.

In this embodiment, as a used refrigerant, taking into consideration a global environment, a combustibility, a toxicity and the like, a carbon dioxide ($CO_2$) corresponding to a natural refrigerant is employed, and the oil corresponding to a lubricating oil employs an existing oil, for example, a mineral oil, an alkyl benzene oil, an ester oil and the like.

Further, refrigerant suction passages (not shown) for introducing the refrigerant and refrigerant discharge passages 86 and 88 for discharging the compressed refrigerant are provided in the upper and lower cylinders 38 and 40. Further, refrigerant pipes 98, 100, 102 and 104 are connected to the respective refrigerant suction passages and refrigerant discharge passages 86 and 88 via connection pipes 90, 92, 94 and 96 fixed to the sealed vessel 12. Further, an accumulator 106 is connected to a portion between the refrigerant pipes 100 and 102. Further, a discharge pipe 108 communicating with the discharge sound absorbing chamber 58 of the upper supporting member 54 is connected to the upper plate 62, whereby the structure is made such as to directly discharge a part of the refrigerant gas compressed at the first stage into the sealed vessel 12 and thereafter flow together with the remaining refrigerant gas discharged from the refrigerant discharging passage 86 in a branch pipe 110 connected to the refrigerant pipe 100.

Next, a description will be given of a summary of an operation of the embodiment mentioned above.

At first, when applying an electric current to the coil 28 of the electrically driven element 14 via the terminal post 20 and the wire (not shown), the rotor 24 rotates and the crank shaft 16 fixed thereto rotates. Due to the rotation, the upper and lower rollers 46 and 48 connected to the upper and lower eccentric portions 42 and 44 integrally provided with the crank shaft 16 eccentrically rotate within the upper and lower cylinders 38 and 40. Accordingly, the refrigerant gas sucked to the low pressure chamber 38*a* of the upper cylinder 38 from the suction port 112 as shown in FIG. 3 via the refrigerant pipe 98 and the refrigerant suction passage (not shown) is compressed at the first stage in accordance with the operation of the upper roller 46 and the upper vane 50. Further, a part of the refrigerant gas having the intermediate pressure and discharged to the discharge sound absorbing chamber 58 of the upper supporting member 54 from the high pressure chamber 38*b* via a discharge port 114 is discharged within the sealed vessel 12 from the discharge pipe 108, and the rest thereof is fed out to the refrigerant pipe 100 through the refrigerant discharge pipe 86 of the upper cylinder 38 so as to flow together with the refrigerant gas flowing therein from the branch pipe 110 in the middle thereof and discharged within the sealed vessel 12.

Next, the refrigerant gas after combination flows to the refrigerant pipe 102 via the accumulator 106, and the refrigerant gas having the intermediate pressure and sucked to the low pressure chamber 40*a* of the low cylinder 40 from a suction port 116 shown in FIG. 3 via the refrigerant suction passage (not shown) is compressed at the second stage in accordance with the operation of the lower roller 48 and the lower vane 52. Further, the high pressure refrigerant gas discharged to the discharge sound absorbing chamber 60 of the lower supporting member 56 from the high pressure chamber 40*b* of the lower cylinder 40 via a discharge port 118 is fed out to an external refrigerant circuit constituting the refrigerant cycle from the refrigerant discharge passage 88 through the refrigerant pipe 104. Thereafter, the suction, compression and discharge operation of the refrigerant gas is executed on the basis of the same passage.

Further, due to the rotation of the crank shaft 16, the lubricating oil (not shown) stored in the bottom portion of the sealed vessel 12 ascends through the oil hole 76 extending in the vertical direction and formed in the axial center of the crank shaft 16, and flows out to the spiral oil supplying grooves 82 and 84 formed on the outer peripheral surface thereof by the oil supplying holes 78 and 80 provided in the middle thereof in the lateral direction. Accordingly, it is possible to well supply the oil to the bearing of the crank shaft 16, the respective sliding portions of the upper and lower rollers 46 and 48 and the upper and lower eccentric portions 42 and 44, so that the crank shaft 16 and the upper and lower eccentric portions 42 and 44 can smoothly rotate.

In this case, it is possible to reduce an increase of temperature of the suction refrigerant gas by forming the refrigerant pipes 90 and 94 connected to the respective refrigerant suction passages of the upper and lower cylinders 38 and 40 in a double-pipe shape or applying a heat insulating agent to an inner wall of the refrigerant pipe, whereby a suction efficiency can be improved. Further, the same effect can be obtained by forming the refrigerant suction passage itself in a double-pipe shape or applying a heat insulating agent to an inner wall of the passage pipe.

INDUSTRIAL APPLICABILITY

In accordance with the present invention, since it is possible to restrict the generation of the oil foaming at a time of starting, it is possible to prevent the oil formed in a foam shape within the sealed vessel from flowing within the cylinder together with the refrigerant gas, and being thereafter discharged out of the compressor, so that it is possible to prevent an oil shortage within the sealed container. Further, it is possible to easily employ a withstand pressure design of a sealed vessel and it is possible to reduce a weight of the pressure vessel. As a result, a performance of the compressor can be improved and a cost can be reduced.

What is claimed is:

1. An internal intermediate pressure type two-stage compression rotary compressor comprising:

an electrically driven element provided within a sealed vessel;

first and second rotary compression elements driven by said electrically driven element;

$CO_2$ refrigerant gas compressed at a first stage by said first rotary compression element, being discharged within said sealed vessel; and the discharged refrigerant gas having an intermediate pressure, being compressed at a second stage by said second rotary compression element, wherein a ratio of volume between the rotary compression element at the first stage and the rotary compression element at the second stage is set so that the equilibrium pressure becomes equal to the intermediate pressure.

2. An internal intermediate pressure type two-stage compression rotary compressor as claimed in claim 1, wherein said ratio of volume is set to a range between 1:0.5 and 1:0.8.

3. An internal intermediate pressure type two-stage compression rotary compressor as claimed in claim 2, wherein said ratio of volume is set to 0.65.

4. An internal intermediate pressure type two-stage compression rotary compressor as claimed in claim 2, wherein said respective rotary compression elements include a cylinder, a roller eccentrically rotating within said cylinder and a vane brought into contact with said roller and sectioning said cylinder into a high pressure chamber and a low pressure chamber, and said ratio of volume between the first stage and the second stage is set to a predetermined range by changing a height of said cylinder.

5. An internal intermediate pressure type two-stage compression rotary compressor as claimed in claim 2, wherein said respective rotary compression elements include a cylinder, a roller eccentrically rotating within said cylinder and a vane brought into contact with said roller and sectioning said cylinder into a high pressure chamber and a low pressure chamber, and said ratio of volume between the first stage and the second stage is set to a predetermined range by changing a diameter of said roller and an amount of eccentricity of the crank shaft.

6. An internal intermediate pressure type two-stage compression rotary compressor as claimed in claim 4 or 5, wherein a material of the roller and the vane constituting the rotary compression element at said first stage is made different from a material of the roller and the vane constituting the rotary compression element at said second stage.

7. An internal intermediate pressure type two-stage compression rotary compressor as claimed in claim 6, wherein the material of the roller and the vane at said second stage is harder than the material of the roller and the vane at said first stage.

* * * * *